United States Patent [19]

Lange et al.

[11] Patent Number: 4,500,219

[45] Date of Patent: Feb. 19, 1985

[54] METHOD AND APPARATUS FOR GUIDING THE PAPER IN TYPEWRITERS OR SIMILAR OFFICE MACHINES

[75] Inventors: Heinz Lange; Albert Rix; Dieter Drogi, all of Wilhelmshaven, Fed. Rep. of Germany

[73] Assignee: Olympia Werke AG, Wilhelmshaven, Fed. Rep. of Germany

[21] Appl. No.: 409,050

[22] Filed: Aug. 18, 1982

[30] Foreign Application Priority Data

Aug. 22, 1981 [DE] Fed. Rep. of Germany ..... 3133297

[51] Int. Cl.[3] ..... B41J 3/04; B41J 11/44; B41J 13/042

[52] U.S. Cl. ..... 400/568; 400/648; 400/639.1; 400/645; 400/637; 400/641; 400/617; 400/600.2; 400/662; 346/138

[58] Field of Search ..... 271/82, 277; 346/138; 400/617, 688, 639.1, 641, 600.2, 637, 613.2, 638, 645.3, 625, 126, 119, 118, 568, 648, 662, 659, 621, 578

[56] References Cited

U.S. PATENT DOCUMENTS

| | | | |
|---|---|---|---|
| 3,732,810 | 5/1973 | Skiba et al. | 400/617 |
| 3,814,011 | 6/1974 | Kashio | 400/126 |
| 3,915,281 | 10/1975 | Blomquist et al. | 400/569 |
| 3,981,388 | 9/1976 | Guilians | 400/662 |
| 4,138,102 | 2/1979 | Palmer | 271/277 |
| 4,195,940 | 4/1980 | Rekewitz | 400/568 |

FOREIGN PATENT DOCUMENTS

| | | | |
|---|---|---|---|
| 2734041 | 5/1979 | Fed. Rep. of Germany . | |
| 2756904 | 6/1979 | Fed. Rep. of Germany | 400/621 |
| 115234 | 10/1978 | Japan | 400/662 |

*Primary Examiner*—William Pieprz
*Attorney, Agent, or Firm*—Spencer & Frank

[57] ABSTRACT

A paper guiding device and operating method for use in an office writing machine, the device including a platen carried by a shaft and constituting a paper support, the platen shaft and platen being rotatable in a first direction for insertion of a paper sheet in the machine and in a second direction opposite to the first direction, a paper holding rail disposed adjacent the platen and carrying a plurality of pressure rollers which are pressed toward the platen, a rocker member supporting the rail and mounted to undergo pivotal movement about the axis of rotation of the platen shaft between a paper insertion position and a normal printing position; and a coupling member coupling the rocker member and platen such that rotation of the platen in the second direction effects pivotal movement of the rocker member into the paper insertion position for insertion of the leading edge of a paper sheet between the rollers and the platen and rotation of the platen in the first direction effects pivotal movement of the rocker member into the normal printing position, with simultaneous transport of the paper sheet, while the rollers maintain the sheet flat against the platen, the normal printing position being sufficiently remote from the printing line to assure that the printed characters will not be smeared upon contact with the rollers.

15 Claims, 5 Drawing Figures

METHOD AND APPARATUS FOR GUIDING THE PAPER IN TYPEWRITERS OR SIMILAR OFFICE MACHINES

BACKGROUND OF THE INVENTION

The present invention relates to a method and an apparatus for guiding the record carrier, i.e. sheet of paper in typewriters or similar office machines.

In office machines provided with an ink jet printer, it is necessary, in order to obtain a perfect recording, for the recording material to rest smoothly against the transporting element, e.g. the platen. For that reason, a special device is used to hold the recording material taut above the printing line. In such printers, paper pressing elements disposed after the printing location, when seen in the transporting direction of the platen, must be designed in such a manner that during the printing process they do not touch the paper during the time required for the ink to dry. Moreover, in such printers, which are designed for high operating speeds, the ink printing head is guided at a very close distance from the record carrier. The demands for accurate guidance of the record carrier in this region are therefore very high.

In one proposed arrangement, smearing of the not yet dry ink is avoided in that the pressure rollers are provided in the form of pressure rings and are disposed on a drive shaft in such a manner that they drive the paper by contacting it in the spaces between the printed characters. This type of paper transport may be suitable for recordings in which the characters have a certain spacing between one another. But in facsimile and proportional script recordings smearing of the not quite dry ink cannot be avoided with this proposed arrangement.

An arrangement disclosed in the IBM Disclosure Bulletin, Vol. 19, No. 3, August, 1976, page 754, includes an endless transporting belt for recording material printed by means of ink jet printers. This transporting belt is not made of a nonwettable or difficutly wettable material. Smearing of the not yet dry characters cannot be avoided here, either.

SUMMARY OF THE INVENTION

It is an object of the present invention to provide a paper guide apparatus for typewriters or similar office machines in which the paper pressing elements assure a constant spacing between the record carrier and the printing head in the region of the printing location and permit contact of the pressure rollers with the printed letters or characters only after the latter have dried, in order to thus avoid smearing of the printed characters.

The above and other objects are achieved, according to the invention, by the provision of a novel paper guiding device for use in an office machine in which successive lines of characters are printed on a paper sheet and which machine includes a carriage supporting a printing head for movement along a printing line. The device comprises: a platen shaft arranged to be rotatably mounted in the machine; a platen carried by the shaft and constituting a paper support; the platen shaft and platen being rotatable in a first direction for insertion of a paper sheet in the machine and in a second direction opposite to the first direction; a paper guide trough surrounding a portion of the platen; a paper holding rail disposed adjacent the platen; a plurality of pressure rollers carried by the rail; spring means disposed for urging the rollers toward the platen; a rocker member supporting the rail and mounted to undergo pivotal movement about the axis of rotation of the platen shaft between a paper insertion position and a normal printing position; and coupling means coupling the rocker member and platen such that rotation of the platen in the second direction effects pivotal movement of the rocker member into the paper insertion position for insertion of the leading edge of a paper sheet between the rollers and the platen and rotation of the platen in the first direction effects pivotal movement of the rocker member into the normal printing position, with simultaneous transport of the paper sheet, while the rollers maintain the sheet flat against the platen, the normal printing position being sufficiently remote from the printing line to assure that the printed characters will not be smeared upon contact with the rollers.

The objects according to the invention are further achieved by a method for inserting, transporting and ejecting sheets of paper in an office machine equipped with a paper guiding device as described above, and equipped with a control unit, a motor connected to rotate the platen, a keyboard having a paper insertion key and a paper ejection key, and a paper sensor disposed in the trough, which method includes the steps of:

(a) inserting a sheet of paper between the platen and the trough while the rocker member is in the normal printing position, and actuating the paper insertion key for causing driving signals to be delivered to the platen under control of the control unit;

(b) aligning the sheet by rotating the platen in the second direction while pivoting the rocker member from the normal printing position into the paper insertion position and automatically locking the rocker member in the paper insertion position;

(c) rotating the platen in the first direction for transporting the sheet until it is sensed by the sensor and its leading edge is introduced between the rollers and the platen;

(d) unlocking the rocker member and rotating the platen in the first direction while pivoting the rocker member in unison toward the normal printing position, and moving the carriage supporting the printing head into a printing position after the rocker member has reached an initial printing position between the paper insertion and normal printing positions;

(e) further rotating the platen in the first direction while correspondingly pivoting the rocker member toward the normal printing position as lines of characters are printed until the rocker member is stopped at the normal printing position;

(f) further rotating the platen in the first direction for advancing the sheet to its end, and then blocking further printing operations while holding the trailing end region of the sheet between the platen and the trough; and (g) actuating the paper ejection key to return the carriage to a rest position spaced from the platen, while transporting the sheet into a depository and halting rotation of the platen in response to the sensor no longer sensing the presence of the sheet.

The apparatus according to the invention permits reliable insertion and transport of record carriers to be printed on, or provided with recordings, by means of ink jet printers, with clean script or facsimile recordings resulting even if slow drying inks are employed. The pivoting of the rocker carrying the pressure rollers about the platen axis from the paper insertion position into the initial printing position and then into the normal printing position assures reliable insertion of the paper and a constant distance between the surface of the sheet of paper and the printing head. The printing head which is outside the printing range when a sheet of paper is inserted is moved to the printing position only after the sheet of paper has been moved into the initial printing position. During this time, the pressure rollers are disposed directly above the printing head which is movable alongside the printing abutment.

Certain preferred embodiments of the invention permit simple adjustment and arresting of the paper pressure rollers on the paper holding rail, while others make possible a simple method for inserting, transporting and ejecting sheets of paper.

The invention will now be explained in greater detail with the aid of an embodiment which is illustrated in the drawing figures.

DESCRIPTION OF THE PREFERRED EMBODIMENTS

Figure 1:
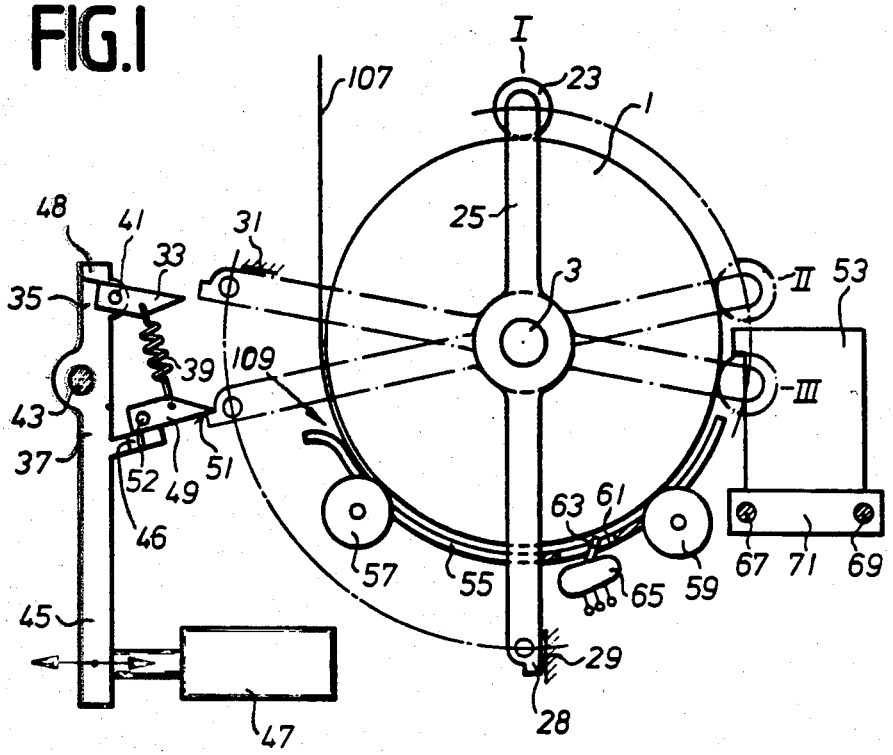
FIG. 1 is a simplified elevational side view of a preferred embodiment of the present invention.
Figure 2:
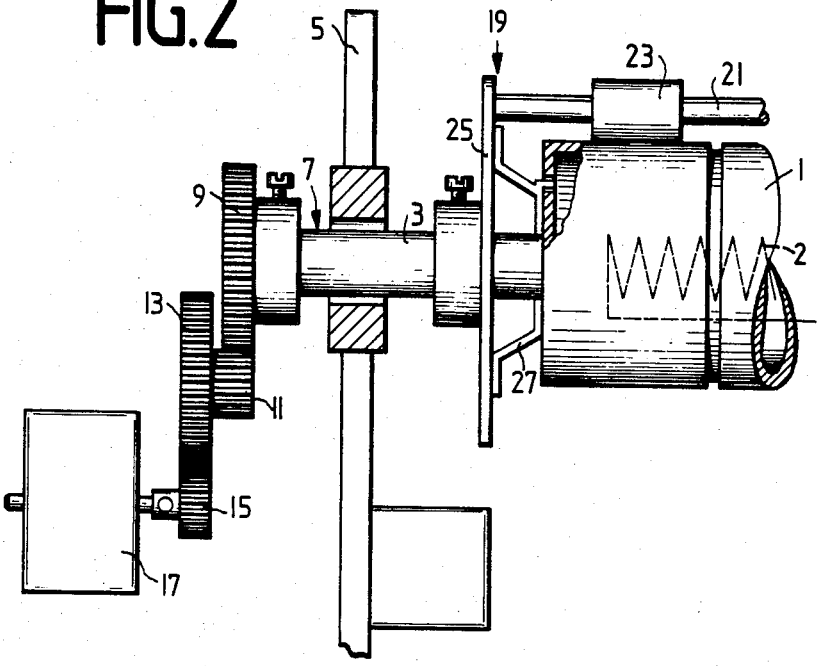
FIG. 2 is a top plan view of part of the embodiment of FIG. 1.

FIGS. 1 and 2 show a platen 1 which is rotatably mounted, via a platen shaft 3, in side walls 5 of the frame of a typewriter or similar office machine. A toothed wheel 9 can be fastened, by a set screw, to the free end of shaft 3. Wheel 9 can be driven by a stepping motor 17 via intermediate gear 11, 13 and 15. A rocker 19 is pivotally mounted on the platen shaft 3 and carries a paper holding rail 21 and paper holding rollers 23. Only one such roller is shown in FIGS. 1 and 2. Rocker 19 is provided with side members 25 designed to serve as bearing elements.

One side member 25 is in a friction locking connection with a brake spring 27 designed as a slide coupling, and additionally has an abutment arm 28 which cooperates with fixed abutments 29 and 31 fixed to the machine frame. The abutments 29 and 31 may be made adjustable and serve to define two end positions for the movement of rocker 19. One end position of rocker 19 is defined by the abutment 31 and is the paper receiving position III, and the other end position is defined by abutment 29 and is the normal printing position setting I for the rocker 19. Spring 27 is fixed to the axial end surface of platen 1.

The abutment arm 28 of the rocker 19, when in the paper receiving position III, can be latched by a detent 33 which is resiliently mounted, under the influence of a tension spring 39, on an arm 35 of a control lever 37 and is mounted to be rotatable about a bearing axis 41. The control lever 37 is pivotal about an axis 43 fixed to the machine frame and is in operative connection with a control electromagnet 47 via a second arm 45.

An abutment latch 49 having an abutment 51 is mounted for rotation about a bearing axis 52 at the second arm 45 and is used to arrest the rocker 19, when it is being pivoted from the normal printing position I, at an initial printing position II so that the pressure rollers 23 are disposed immediately above the printing head 53 which can be moved along the platen 1. Arm 45 carries an abutment element 46 which cooperates with latch 49 to prevent that latch from pivoting counterclockwise from the position shown in FIG. 1 while permitting latch 49 to pivot clockwise, against the biassing force of spring 39, from the illustrated position. Latch 49 will be pivoted clockwise, when lever 37 is in the position shown in FIG. 1, by the action of arm 28 as rocker 19 pivots from position III toward position I. Similarly, detent 33 can pivot counterclockwise from the position shown in FIG. 1, but is prevented from clockwise pivoting by an abutment 48 carried by arm 35 of lever 37.

This stop is necessary when the sheet of paper is transported in a direction opposite to the paper insertion direction because the pressure rollers 23 could otherwise abut against the printing head 53 when it is still in the printing region and could then cause malfunctions. The abutment latch 49 blocks the rocker 19 only against rotation in a direction opposite the direction of paper insertion, i.e. against rotation in a clockwise direction in FIG. 1. When rocker 19 rotates in the paper insertion direction, i.e. from the paper receiving position III toward the normal printing position I, abutment arm 28 can resiliently deflect latch 49 and escape therepast. Detent 33, however, when in the path of arm 28, prevents movement of arm 28 from the paper receiving position III; during movement of arm 28 toward the paper receiving position III, it can resiliently deflect detent 33 and moves therepast.

Below the platen 1 there is a paper guide trough 55 with pressure rollers 57 and 59 of which only two are shown in FIG. 1. Between the pressure rollers 57 and 59, the paper guide trough 55 has a recess 61 through which a sensor element 63 of a sensor switch 65 passes to sense the presence of a sheet of paper. The sensor switch 65 is, for example, a microswitch, but can also be a photoelectric element.

The printing head 53 is an ink jet printing head which is disposed on a carriage 71 guided on shafts 67 and 69 along the platen 1, perpendicular to the plane of FIG. 1. The carriage 71 is moved by means of a conventional transporting device (not shown), e.g. a stepping motor.

Figure 3:
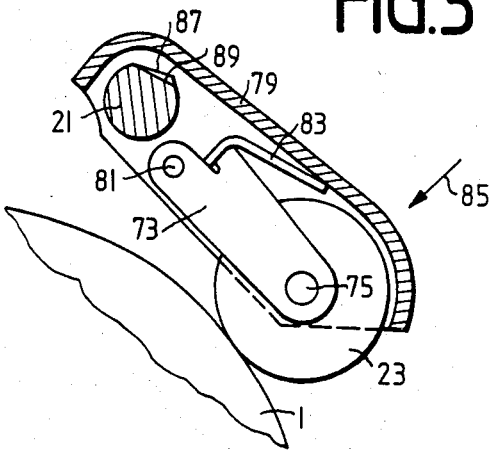
FIG. 3 is a detail view of a portion of the device of FIGS. 1 and 2.

Referring to FIG. 3, each pressure roller 23 of the rocker 19 is rotatably mounted on a shaft 75 carried by a saddle-shaped roller mount 73 made of spring steel. The roller mount 73 is mounted to be pivotal about a bearing axis 18 in a guide member 79 which is supported by, and displaceable along, the paper holding rail, which rail has a profiled form, as shown. Moreover, the roller mount 73 carries a projecting resilient arm 83 which generates a force to clamp guide member 79 on the paper holding rail 21 and to urge the pressure roller 23 against the platen 1.

The paper holding rail 21 has a generally cylindrical shape but includes a flattened portion 89, while the guide member 79 which is displaceably mounted on rail 21 has a correspondingly designed bearing recess including a flattened portion 87 so that member 79 is pivotal within limits relative to rail 21. If the guide member 79 is urged by finger pressure in the direction of the arrow 85 as shown in FIG. 3, the clamping effect between paper holding rail 21 and bearing recess 87 is released in such a manner that the guide member 79 can easily be moved laterally and will automatically clamp itself onto rail 21 when the finger pressure is released.

Figure 5:
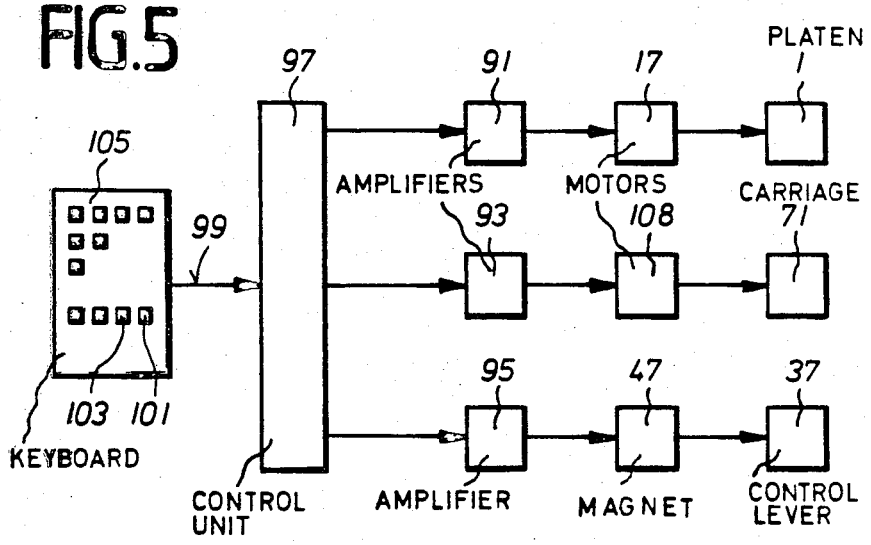
FIG. 5 is a block circuit diagram of a system for carrying out the method according to the invention.

The procedure for inserting, transporting and ejecting sheets of papers will now be explained with the aid of the programming flow diagram of FIG. 4 and the block circuit diagram of FIG. 5. When the machine is switched off and during periods when no printing is being performed, printing head 53 and carriage 71 move outside the printing region. Only when carriage 71 is in this position, can a paper insertion key 101 of a keyboard 105 give coded signals over a line 99 to a control unit 97, which may be a microprocessor or also a commercially available computer.

The control unit 97 receives the data, makes certain calculations and transmits driving pulses via amplifiers 91 and 95 to the stepping motor 17 for the platen 1 and to the control magnet 47 for the control lever 37. Actuation of the control magnet 47 pivots the control lever 37 clockwise, in the plane of FIG. 1, so that the abutment latch 49 is moved out of the path of movement of arm 28 and the detent 33 is brought into that path of movement. The stepping motor 17 is supplied with driving pulses by the control unit 97 in such a manner that the platen 1 is rotated opposite to the paper insertion direction, i.e. clockwise in FIG. 1, by ten steps, corresponding to ten printing lines. The platen 1 thereby moves the rocker 19 and the paper holding rollers 23 clockwise, in the plane of FIG. 1, via the brake spring 27, from the normal printing position I into the paper receiving position III. The pivoting movement of the rocker 19 is limited by the abutment 31 causing the detent 33 to be arrested beneath the abutment arm 28 of the rocker 19. This prevents undesired counterclockwise return pivoting of the rocker 19.

Then the stepping motor 17 is supplied with driving pulses for the opposite direction of rotation by the control element 97 in such a manner that the platen is rotated forward, i.e. counterclockwise, by 15 steps. During these 15 steps, the sensor switch 65 senses the presence of a sheet of paper 107 in the paper guide trough 55. If a sheet of paper 107 is present, the platen is shifted forward by an additional 10 steps until at least the leading edge of the sheet of paper 107 itself is disposed under the paper holding rollers 23.

Then the control magnet 47 is switched off by the control element 97 and the platen 1 is advanced by four more steps in the forward direction until rocker 19 reaches the initial printing position II. In this position, a stepping motor 108 receives driving pulses for the carriage 71 equipped with the printing head 53. These signals come from the control element 97 via an amplifier 93. Thus, the printing head 53 is brought into the printing position and is guided directly below the paper pressure rollers 23 along the platen 1. The printing head 53 is disposed on carriage 71 which is guided on shafts 67 and 69. The direction of movement of carriage 71 is parallel to the platen 1, perpendicular to the plane of FIG. 1.

After the printing head 53 reaches the printing position, the machine operator can begin putting in printing instructions. This is done in that the keyboard 105 delivers to unit 97, via line 99, signals which are coded to correspond to the characters to be printed, in response to which unit 97, in a conventional manner, transmits corresponding ink ejection instructions to the printing head 53. During this printing process, the platen 1 is advanced counterclockwise in a known manner in the paper insertion direction, thus moving the rocker 19 in steps from the initial printing position II into the normal printing position I.

After the rocker 19 has reached the normal printing position I, only the platen 1 continues to be advanced as further lines are printed. The normal printing position I is disposed far enough away from the printing location that the printed characters are already dry when they come into contact with the drive rollers 23. Smearing of the printed characters is avoided since the sheet of paper 107 is always held flat against the platen 1 in the printing region.

Four steps before the end of the paper reaches the printing position, warning signals are emitted. When the end of the paper is reached, the keyboard is blocked, permitting the functions "reverse platen" and "backspace" still to be performed. In this position, the end of the sheet of paper 107 is still in the paper guide trough 55 so that it still rests flat against the platen 1 and thus cannot come closer to the ink jet printing head 53. The warning signals for the paper end are produced by sensor switch 65 which is located in the trough 55 more than four steps away from the printing head 53.

To eject the sheet of paper, a paper ejection key 103 in the keyboard 105 is actuated. This sends a coded signal to the control unit 97, causing driving pulses to be conducted via amplifier 93 to the stepping motor 108 for the carriage 71. The carriage 71 with the printing head 53 are thus moved outside of the printing region. Then the stepping motor 17 receives driving pulses via amplifier 91, also from the control unit 97 to rotate the platen by 10 steps in the paper ejection direction, i.e. counterclockwise. After 10 further steps by the platen 1, the sensor switch 65 makes an interrogation. If no paper is present any longer, the stepping motor 17 receives enough driving pulses from the control unit 97 to advance the platen 1 by 20 further steps. This assures that the completed sheet of paper 107 is reliably moved into a depository. This depository is located above the platen 1 in the frame of the typewriter and includes unitarily assoicated feed and receiving magazines in known manner as disclosed in U.S. Pat. No. 3,430,748.

A new sheet of paper 10 is then pushed over a guide 109 into the insertion gap between the platen 1 and the paper guide trough 55, and the paper insertion key 101 can be actuated anew. The insertion of the new sheet of paper 107 takes place in the manner described above. By returning the platen 1 and pivoting back the rocker 19 from the normal printing position I to the paper receiving position III, the sheet of paper is aligned automatically. The apparatus according to the invention and the method according to the invention permit reliable insertion, transport and ejection of sheets of paper.

The platen 1 can be designed as a hollow roller, its jacket being made of metal, e.g. aluminum. A heating element 2 is preferably disposed in the interior of the platen. This heating element may be an infrared lamp, a heating coil or some other heat radiator. The platen 1 preferably has a much greater diameter than prior art platens and thus effects reduced bending of the sheet of paper as a result of having been guided around the heated platen 1. The diameter of the platen 1 has an amount of 80,85 mm. The prior platens have a diameter of 40.5 mm.

Figure 4:
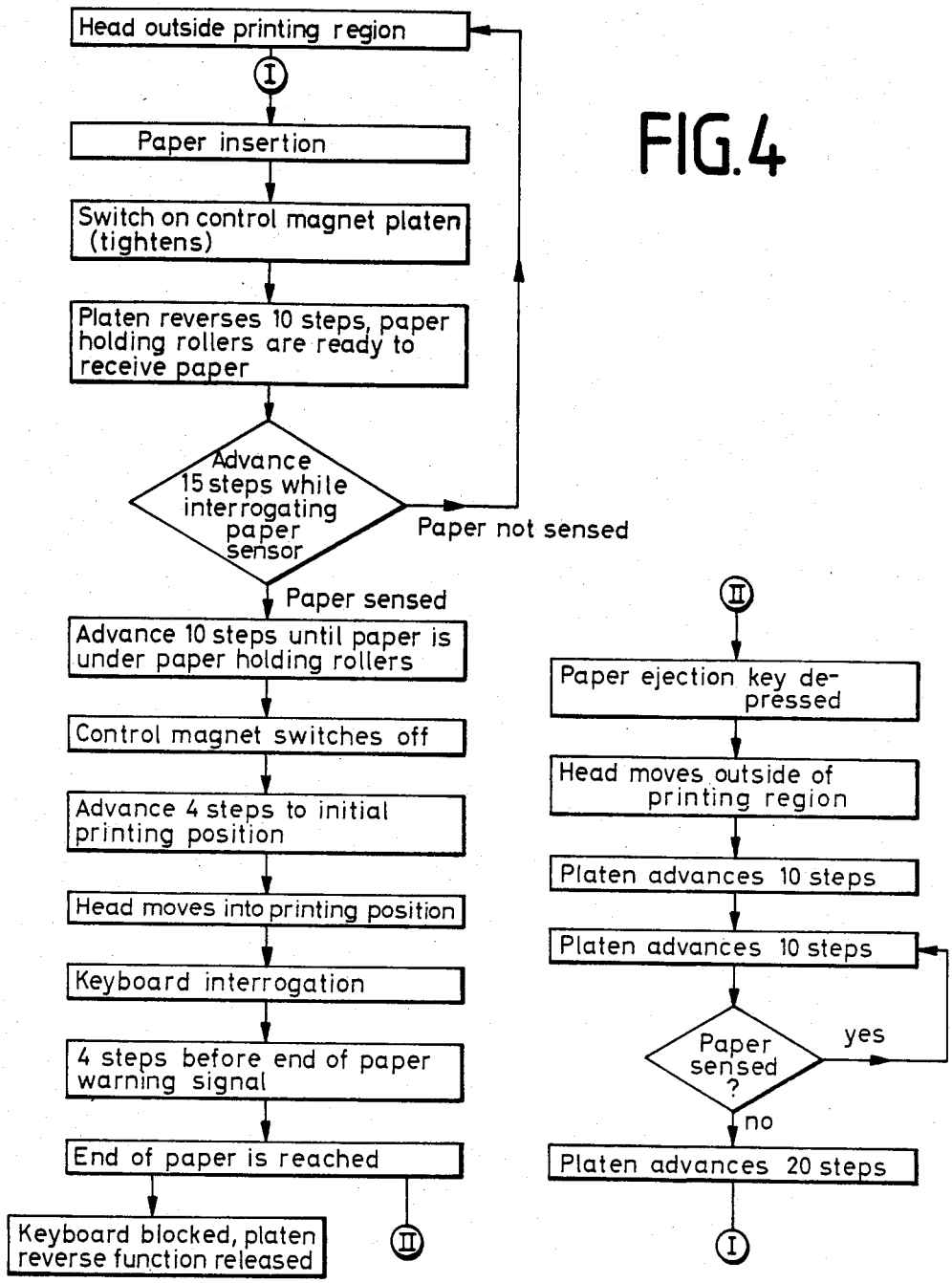
FIG. 4 is a programming flow diagram illustrating the method according to the invention.

The lower right-handed side of FIG. 4 shows the sequence of operation during the ejection of sheets of paper. The left-handed side of FIG. 4 contains the sequence of operation during the insertion of sheets of paper. When the ejection of a sheet of paper is finished then the insertion of a new sheet of paper takes place, as signified by the I near the top of FIG. 4.

It will be understood that the above description of the present invention is susceptible to various modifications, changes and adaptations, and the same are intended to be comprehended within the meaning and range of equivalents of the appended claims.

What is claimed is:

1. A paper guiding device for use in an office machine in which successive lines of characters are printed on a paper sheet with an ink which can be smeared for a short period after application to the sheet, and which machine includes a carriage supporting a printing head for movement along a printing line, said device comprising: a platen shaft arranged to be rotatably mounted in the machine; a platen carried by said shaft and constituting a paper support; said platen shaft and platen being rotatable in a first direction for insertion and feeding of a paper sheet in the machine and in a second direction opposite to the first direction; a paper guide trough surrounding a portion of said platen; a paper holding rail disposed adjacent said platen; a plurality of pressure rollers carried by said rail; spring means disposed for urging said rollers toward said platen in order to press a paper sheet against said platen; a rocker member supporting said rail and mounted to undergo pivotal movement about the axis of rotation of said platen shaft between a paper insertion position and a normal printing position; and coupling means coupling said rocker member and platen such that: rotation of said platen in said second direction effects pivotal movement of said rocker member into said paper insertion position for insertion of the leading edge of a paper sheet between said rollers and said platen; rotation of said platen in said first direction during insertion and feeding of a paper sheet is accompanied by maintenance of said rocker member in said paper insertion position until the leading edge of such paper sheet is pressed between said rollers and said platen; and further rotation of said platen in said first direction effects pivotal movement of said rocker member into said normal printing position, with simultaneous transport of the paper sheet, while said rollers maintain the sheet flat against said platen, said normal printing position being sufficiently remote from the printing line to assure that the printed characters will not be smeared upon contact with said rollers.

2. A device as defined in claim 1 wherein said rocker member has an abutment arm disposed to be brought into a respective operative position against a respective abutment associated with the machine in each said position of said rocker member.

3. A device as defined in claim 2 further comprising controllable first detent means disposed for latching said abutment arm in position when said rocker member is in one of its said positions.

4. A device as defined in claim 3 further comprising controllable second detent means disposed and controlled for blocking said abutment arm at a location where said rocker member is in an initial printing position where said rollers are disposed directly above the printing head.

5. A device as defined in claim 4 further comprising: a control lever pivotally mountable in the machine; a first latch pivotally mounted on said pivot lever and carrying said second detent means; and a control magnet disposed for controlling the pivotal movement of said lever for moving said first latch.

6. A device as defined in claim 5 wherein said control lever has a free arm carrying said first detent means.

7. A device as defined in claim 1 wherein said rail has a profiled form, and further comprising a plurality of saddle-shaped roller mounts made of spring steel and each pivotally mounted on said rail and carrying a respective roller, each said mount being formed to be clamped to said rail upon pivoting relative thereto to a predetermined position, and wherein said spring means comprise a plurality of resilient members each carried in a respective mount for urging its said mount toward said predetermined position for clamping that said mount to said rail.

8. A device as defined in claim 7 wherein said rail has a generally cylindrical form with a flattened portion, and each said mount is provided with an opening corresponding in form to said rail and through which said rail passes, for permitting said mount to pivot relative to said rail by a predetermined extent and to be displaceable along the length of said rail when not clamped to said rail.

9. A device as defined in claim 1 further comprising: a first stepping motor; a toothed wheel fixed to said platen shaft; and a gear drive coupling said motor to said wheel.

10. A device as defined in claim 1 wherein said coupling means is a slide coupling comprising a brake spring fixed to said platen and frictionally engaging said rocker member, and said rocker member is pivotally mounted on said platen shaft.

11. A device as defined in claim 1 further comprising: a stepping motor connected to displace the printing head carriage; and a paper sheet sensor mounted in said trough.

12. A device as defined in claim 1 wherein said platen has a large diameter and comprises: a hollow roll defined by a metal jacket; and a heating element at the interior of said roll.

13. A method for inserting, transporting and ejecting sheets of paper in an office machine equipped with a paper guiding device as defined in claim 1, and equipped with a control unit, a motor connected to rotate said platen, a keyboard having a paper insertion key and a paper ejection key, and a paper sensor disposed in said trough, comprising the steps of:

(a) inserting a sheet of paper between said platen and said trough while said rocker member is in said normal printing position, and actuating the paper insertion key for causing driving signals to be delivered to said platen under control of said control unit;

(b) aligning the sheet by rotating said platen in said second direction while pivoting said rocker member from said normal printing position into said paper insertion position and automatically locking said rocker member in said paper insertion position;

(c) rotating said platen in said first direction for transporting the sheet until it is sensed by the sensor and its leading edge is introduced between said rollers and said platen;

(d) unlocking said rocker member and rotating said platen in said first direction while pivoting said rocker member in unison toward said normal printing position, and moving the carriage supporting the printing head into a printing position after said rocker member has reached an initial printing position between said paper insertion and normal printing positions;

(e) further rotating said platen in said first direction while correspondingly pivoting said rocker member toward said normal printing position as lines of characters are printed until said rocker member is stopped at said normal printing position;

(f) further rotating said platen in said first direction for advancing the sheet to its end, and then blocking further printing operations while holding the trailing end region of the sheet between said platen and said trough; and (g) actuating the paper ejection key to return the carriage to a rest position spaced from said platen, while transporting the sheet into a depository and halting rotation of said platen in response to the sensor no longer sensing the presence of the sheet.

14. A device as defined in claim 2 further comprising controllable blocking detent means disposed and controlled for blocking said abutment arm at a location where said rocker member is in an initial printing position where said rollers are disposed directly above the printing head.

15. A device as defined in claim 14 further comprising: a control lever pivotally mountable in the machine; a first latch pivotally mounted on said pivot lever and carrying said blocking detent means; and a control magnet disposed for controlling the pivotal movement of said lever for moving said first latch.

* * * * *